US010518550B2

(12) United States Patent
Matsumoto

(10) Patent No.: US 10,518,550 B2
(45) Date of Patent: Dec. 31, 2019

(54) LIQUID SUPPLY DEVICE, LIQUID SUPPLY METHOD, LIQUID APPLICATION APPARATUS, AND IMAGE FORMING SYSTEM

(71) Applicant: Tetsuya Matsumoto, Ibaraki (JP)

(72) Inventor: Tetsuya Matsumoto, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/163,711

(22) Filed: Oct. 18, 2018

(65) Prior Publication Data

US 2019/0152230 A1 May 23, 2019

(30) Foreign Application Priority Data

Nov. 17, 2017 (JP) ..... 2017-222262

(51) Int. Cl.
*B41J 2/175* (2006.01)
*B41J 29/38* (2006.01)

(52) U.S. Cl.
CPC ..... *B41J 2/17596* (2013.01); *B41J 2/175* (2013.01); *B41J 2/17563* (2013.01); *B41J 2/17566* (2013.01); *B41J 29/38* (2013.01)

(58) Field of Classification Search
CPC .... B41J 2/175; B41J 2/17563; B41J 2/17566; B41J 2/17596; B41J 29/38
See application file for complete search history.

(56) References Cited

U.S. PATENT DOCUMENTS 7,360,882 B2 * 4/2008 Ikeda ..... B41J 2/19 347/6
8,038,267 B2 * 10/2011 Kinase ..... B41J 2/17596 347/85
9,162,507 B2 * 10/2015 Tanaka ..... B41J 2/175
2006/0132554 A1 * 6/2006 Ota ..... B41J 2/17556 347/85
2010/0245495 A1 * 9/2010 Katada ..... B41J 2/175 347/85
2015/0224775 A1 8/2015 Matsumoto
2017/0001445 A1 1/2017 Matsumoto

FOREIGN PATENT DOCUMENTS

JP 2006-247936 9/2006
JP 2014-100805 6/2014

* cited by examiner

*Primary Examiner* — Anh T Vo
(74) *Attorney, Agent, or Firm* — Harness, Dickey & Pierce, P.L.C.

(57) ABSTRACT

A liquid supply device includes a first tank to store a liquid, a first pump to supply the liquid from the first tank to a liquid pan, as a first supply operation, a second tank coupled to the first tank, and a second pump to supply the liquid from the second tank to the first tank, as a second supply operation. The liquid supply device further includes circuitry configured to control the first supply operation and the second supply operation. The circuitry accumulates operation time of the first supply operation and starts the second supply operation at a start of the first supply operation under a condition where a cumulative operation time of the first supply operation is equal to or longer than a threshold.

9 Claims, 11 Drawing Sheets

MAIN PUMP 610
AIR-RELEASE SOLENOID VALVE 650
SUB PUMP 660
x
t11
t12
t13
t14
t15
t16
t17
t19

MAIN PUMP 610
AIR-RELEASE SOLENOID VALVE 650
SUB PUMP 660
x
t11
t12
t13
t14
t16
t18
t19

LIQUID SUPPLY DEVICE, LIQUID SUPPLY METHOD, LIQUID APPLICATION APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application No. 2017-222262, filed on Nov. 17, 2017, in the Japan Patent Office, the entire disclosure of which is hereby incorporated by reference herein.

BACKGROUND

Technical Field

The present disclosure relates to a liquid supply device, a liquid supply method, a liquid application apparatus, and an image forming system.

Description of the Related Art

There are image forming systems that include an image forming apparatus and a pretreatment apparatus. The image forming apparatus applies ink to a recording medium to form an image. The pretreatment apparatus performs pretreatment, which is a process preceding to image formation on the recording medium. The pretreatment is a process aimed at improving quality such as ink bleeding, density, color tone, bleed-through, etc. on the recording medium. For example, the pretreatment is application of a material containing a component to aggregate the colorant of the ink to the recording medium. Such a pretreatment apparatus includes a treatment liquid pan (i.e., a liquid reservoir) to store the treatment liquid to be applied to the recording medium and a liquid supply device to supply the treatment liquid to the liquid container.

Further, there are liquid supply devices that include a plurality of tanks having different capacities, for storing the treatment liquid supplied to the treatment liquid pan. In the liquid supply device including the plurality of tanks having different capacities, the liquid supply device supplies the treatment liquid to the treatment liquid pan from a small capacity tank. When the treatment liquid of the small capacity tank is reduced, the liquid supply device replenishes the small capacity tank with the treatment liquid from a large capacity tank. Such a liquid supply device generally includes a mechanism to detect the timing of start of supply or replenishment of the treatment liquid for each of the treatment liquid pan and the small capacity tank. For example, the mechanism to detect includes a liquid level sensor to detect the surface level of the treatment liquid.

SUMMARY

According to an embodiment of this disclosure, a liquid supply device includes a first tank to store a liquid, a first pump to supply the liquid from the first tank to a liquid pan, as a first supply operation, a second tank coupled to the first tank, and a second pump to supply the liquid from the second tank to the first tank, as a second supply operation. The liquid supply device further includes circuitry configured to control the first supply operation and the second supply operation. The circuitry accumulates operation time of the first supply operation and starts the second supply operation at a start of the first supply operation under a condition where a cumulative operation time of the first supply operation is equal to or longer than a threshold.

According to another embodiment, a liquid application apparatus includes the liquid pan and the liquid supply device described above. The liquid supply device supplies the liquid to the liquid pan.

Yet another embodiment provides an image forming system that includes the above-described liquid application apparatus, to apply the liquid to a recording medium; and an image forming apparatus to perform an image on a recording medium applied with the liquid by the liquid application apparatus.

Yet another embodiment provides a liquid supply method that includes supplying a liquid from a first tank to a liquid pan, as a first supply operation; supplying the liquid from a second tank to the first tank, as a second supply operation; accumulating an operation time of the first supply operation; determining whether a cumulative operation time of the first supply operation is equal to or longer than a threshold; determining a start of the first supply operation after a determination that the cumulative operation time of the first supply operation is equal to or longer than the threshold; and starting the second supply operation at the start of the first supply operation.

Yet another embodiment provides a non-transitory recording medium storing computer-readable codes for causing a computer to carry out the liquid supply method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
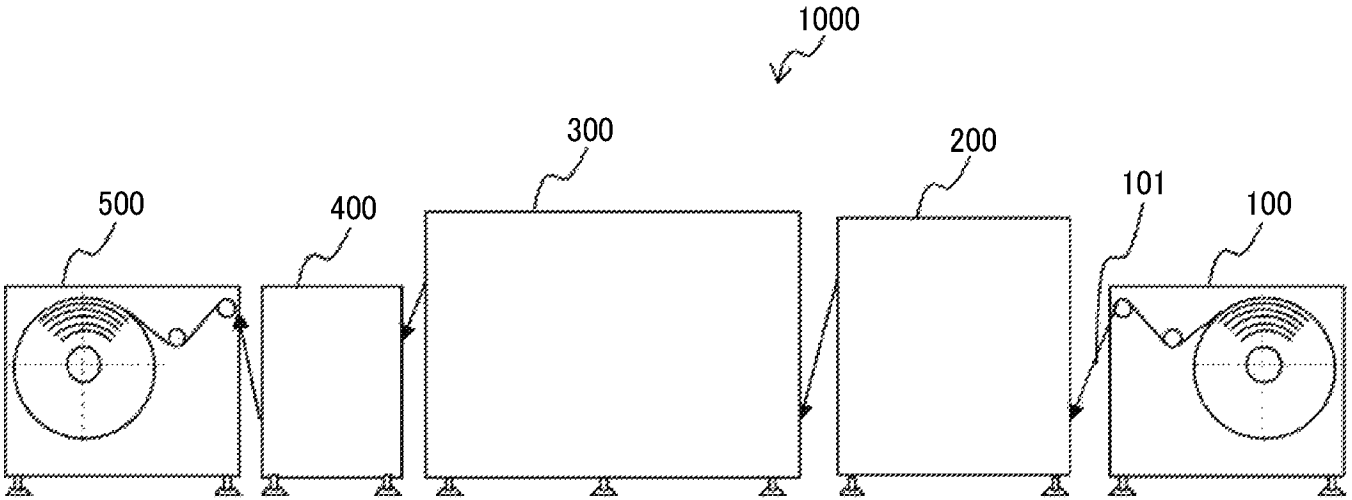
FIG. 1 is a schematic view of an image forming system according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a liquid supply device, a liquid supply method, a liquid application apparatus, and an image forming system according to embodiments of this disclosure are described. The image forming system includes the liquid application apparatus as a pretreatment apparatus and an image forming apparatus disposed at a stage subsequent to the pretreatment apparatus. The liquid application apparatus includes the liquid supply device. As used herein, the singular forms "a", "an", and "the" are intended to include the plural forms as well, unless the context clearly indicates otherwise.

FIG. 1 is a schematic view of an image forming system 1000 according to the present embodiment. The image forming system 1000 applies ink and the like to a sheet-like recording medium (sheet material) that is rolled, to form an image on the recording medium. In the present embodiment, as pretreatment, treatment liquid is applied to the recording medium before an image is formed thereon. The pretreatment is performed to maintain and improve image quality. Aspects of this disclosure can adopt to, not limited to the image forming system, any system or apparatus having a structure to supply a material used for pretreatment. For example, aspects of this disclosure can adapt to a fabricating system to form not an image on a plane but forms a three-dimensional object and supplies a material used for pretreatment before formation of the object. The fabricating system applies a fabrication material to a support for fabricating the object.

The image forming system 1000 illustrated in FIG. 1 includes a sheet feeder 100, a pretreatment apparatus 200, an image forming apparatus 300, a post-processing apparatus 400, and a winder 500.

The sheet feeder 100 supplies, as a recording medium, a continuous sheet 101 rolled and has a function of holding the continuous sheet 101 and discharging the continuous sheet 101 to the pretreatment apparatus 200.

The pretreatment apparatus 200 applies liquid (treatment liquid) to the continuous sheet 101 and dries the continuous sheet 101. The treatment liquid contains a pretreatment agent used for preventing bleeding or bleed-through of an image forming material such as ink applied to the continuous sheet 101 by the image forming apparatus 300.

The image forming apparatus 300 applies ink or the like onto the continuous sheet 101 for forming an image thereon (image formation and output or simply "image output") after the treatment liquid applied to the continuous sheet 101 is dried. Then, the image forming apparatus 300 discharges the continuous sheet 101 on which the image is formed. The image forming apparatus 300 is, for example, an inkjet printer (an inkjet recording apparatus).

The post-processing apparatus 400 performs post-processing on the continuous sheet 101 discharged from the image forming apparatus 300.

The winder 500 reels the continuous sheet 101 in a roll after the post-treatment. As the winder 500 winds the continuous sheet 101 in a roll, tension is applied to the continuous sheet 101, and the continuous sheet 101 is conveyed from the sheet feeder 100 toward the winder 500. Hereinafter, in the direction of conveyance of the continuous sheet 101, the side on the sheet feeder 100 is referred to as upstream, and the side on the winder 500 is referred to as downstream.

In the image forming system 1000, the order of connection among the sheet feeder 100, the pretreatment apparatus 200, the image forming apparatus 300, the post-processing apparatus 400, and the winder 500 can be changed according to the image formation on the continuous sheet 101. Also, some apparatus or devices may be selectively connected. For example, in a case where the post-processing apparatus 400 is a device that performs bookbinding, folding, or cutting processing, the winder 500 can be disposed downstream from the image forming apparatus 300, and the post-processing apparatus 400 can be disposed downstream from the winder 500. In the case of the continuous sheet 101 unnecessary for pretreatment or in the case where the rolled continuous sheet 101 after the pretreatment is set in the sheet feeder 100, not the pretreatment apparatus 200 but the image forming apparatus 300 can be disposed downstream from the sheet feeder 100.

For example, a controller of the image forming apparatus 300 governs overall operation of the image forming system 1000. In this case, the sheet feeder 100, the pretreatment apparatus 200, the post-processing apparatus 400, and the winder 500 can be regarded as external devices relative to the image forming apparatus 300.

In addition, each of the sheet feeder 100, the pretreatment apparatus 200, the post-processing apparatus 400, and the winder 500 of the image forming system 1000 includes hardware capable of executing information processing as described later. In addition, each apparatus includes hardware constructing an engine that executes unique functions. For example, the pretreatment apparatus 200 can detect the operation state of the image forming apparatus 300 and execute the specific function of the pretreatment apparatus 200. That is, the image forming system 1000 can have either a configuration in which other apparatuses execute respective operations instructed by the image forming apparatus 300 or a configuration in which each apparatus independently executes the operation unique to each apparatus.

Figure 2:
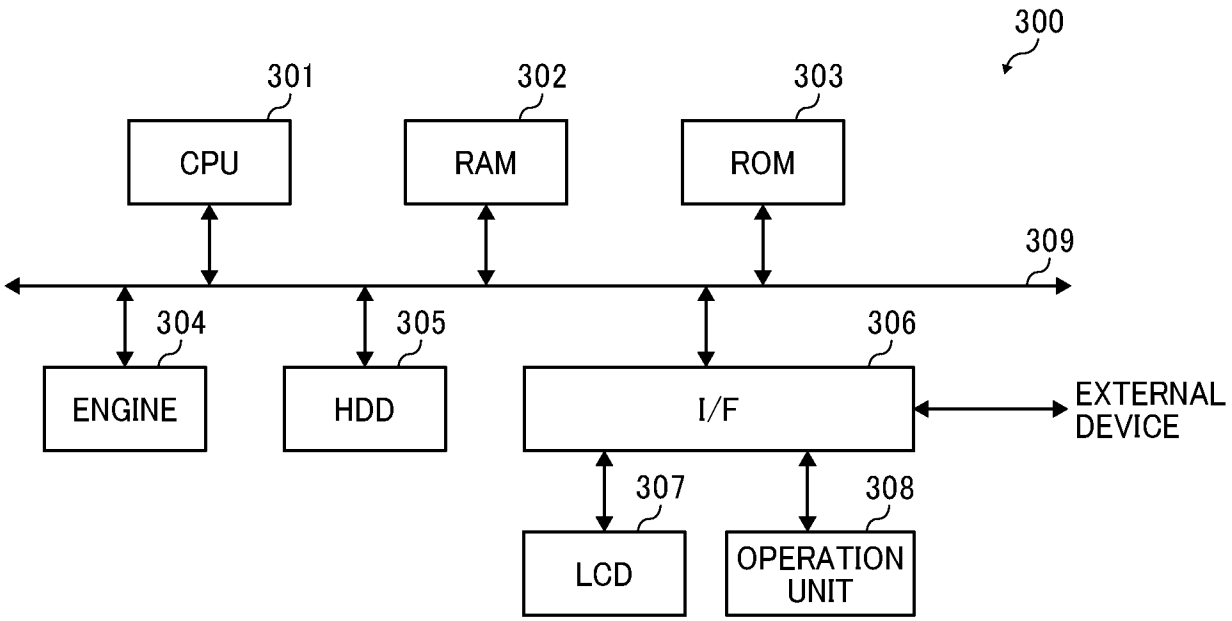
FIG. 2 is a schematic block diagram of a hardware configuration of an image forming apparatus according to an embodiment of the present disclosure.

Next, the hardware configuration of each apparatus of the image forming system 1000 will be described, using the hardware configuration of the image forming apparatus 300 illustrated in FIG. 2 as a representative. Note that FIG. 2 illustrates an example hardware configuration in the case where the image forming apparatus 300 performs integrated processing of the image forming system 1000. Hereinafter, the hardware configuration of the image forming apparatus 300 will be described. The sheet feeder 100, the post-processing apparatus 400, and the winder 500 have the same hardware configuration as the hardware configuration of the image forming apparatus 300, and redundant explanation is omitted.

As illustrated in FIG. 2, the image forming apparatus 300 has a configuration similar to a general information processing apparatus such as a server and a personal computer (PC) and includes an engine to implement image formation. That is, the image forming apparatus 300 according to the present embodiment includes a central processing unit (CPU) 301, a random access memory (RAM) 302, a read only memory (ROM) 303, an engine 304, a hard disc drive (HDD) 305, and an interface (I/F) 306, which are connected to each other via a bus 309. A liquid crystal display (LCD) 307 and an operation unit 308 are connected to the I/F 306. Furthermore, the image forming apparatus 300 exchanges signals with other external devices connected to the image forming apparatus 300 via the OF 306.

The CPU 301 is a calculator or computing device that controls overall operation of the image forming apparatus 300. The RAM 302 is a volatile storage medium capable of high-speed reading and writing. The CPU 301 uses the RAM 302 as a work area in processing information. The ROM 303 is a non-volatile storage medium dedicated to reading out and stores programs such as firmware. The engine 304 is a mechanism that executes image formation in the image forming apparatus 300.

The HDD 305 is a non-volatile storage medium capable of reading information and writing information. The HDD 305 stores, e.g., an operating system (OS), various kinds of control programs, and application programs. The OF 306 connects the bus 309 to various hardware components or networks for control. The LCD 307 is a visual user interface for users to check a status of the image forming system 1000. The operation unit 308 is a user interface, such as a keyboard and a mouse, for a user to input information to the image forming system 1000.

In the hardware configuration exemplified above, a program stored in the ROM 303, the HDD 305, or an external recording medium such as an optical disc is read into the RAM 302 and executed under the control of the CPU 301. This operation constructs a software controller in the image forming apparatus 300. The combination of the software controller thus configured with the hardware forms a display panel 37 which implements the function of the image forming apparatus 300. Note that also in the sheet feeder 100, the post-processing apparatus 400, and the winder 500 having the same hardware configuration as the configuration of the image forming apparatus 300, the display panel 37 can be implemented by a similar combination of the software controller and hardware.

Figure 13:
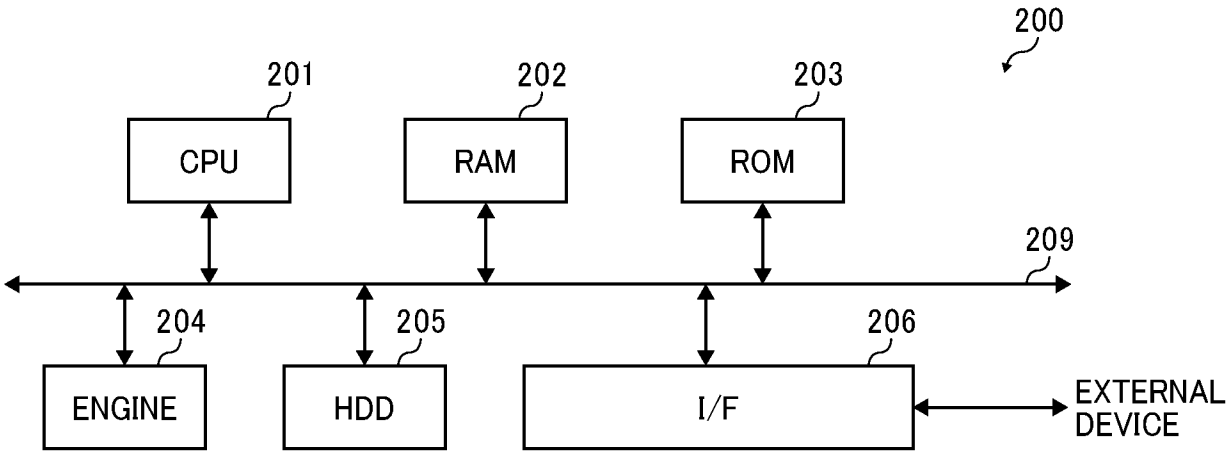
FIG. 13 is a block diagram illustrating a hardware configuration of the pretreatment apparatus illustrated in FIG. 4.

Referring to FIG. 13, descriptions are given a hardware configuration of the pretreatment apparatus 200, which is similar to the hardware configuration of the image forming apparatus 300 illustrated in FIG. 2, but the pretreatment apparatus 200 does not have a configuration corresponding to the LCD 307 and the operation unit 308.

As illustrated in FIG. 13, the pretreatment apparatus 200 has a configuration similar to a general information processing apparatus such as a server and a personal computer (PC) and includes an engine to implement the pretreatment. That is, in the pretreatment apparatus 200, a CPU 201, a RAM 202, a ROM 203, an engine 204, an HDD 205, and an OF 206 are connected via a bus 209. Furthermore, the pretreatment apparatus 200 exchanges signals with other external devices connected to the pretreatment apparatus 200 via the OF 206.

The CPU 201 is a computation device and controls actions of the entire pretreatment apparatus 200. The RAM 202 is a volatile storage medium (memory) capable of high-speed data reading and writing. The RAM 202 is used as workspace when the CPU 201 processes information. The ROM 203 is a non-volatile storage medium dedicated to reading out and stores programs such as firmware. The engine 204 is a mechanism that executes the pretreatment in the pretreatment apparatus 200.

The HDD 205 is a non-volatile storage medium capable of reading information and writing information. The HDD 205 stores, e.g., an operating system (OS), various kinds of control programs, and application programs. The OF 206 connects the bus 209 to various hardware components or networks for control.

In the hardware configuration exemplified above, a program stored in the ROM 203, HDD 205, or an external recording medium such as optical disc is read into the RAM 202 and executed under the control of the CPU 201. This operation implements a software controller in the pretreatment apparatus 200.

Figure 3:
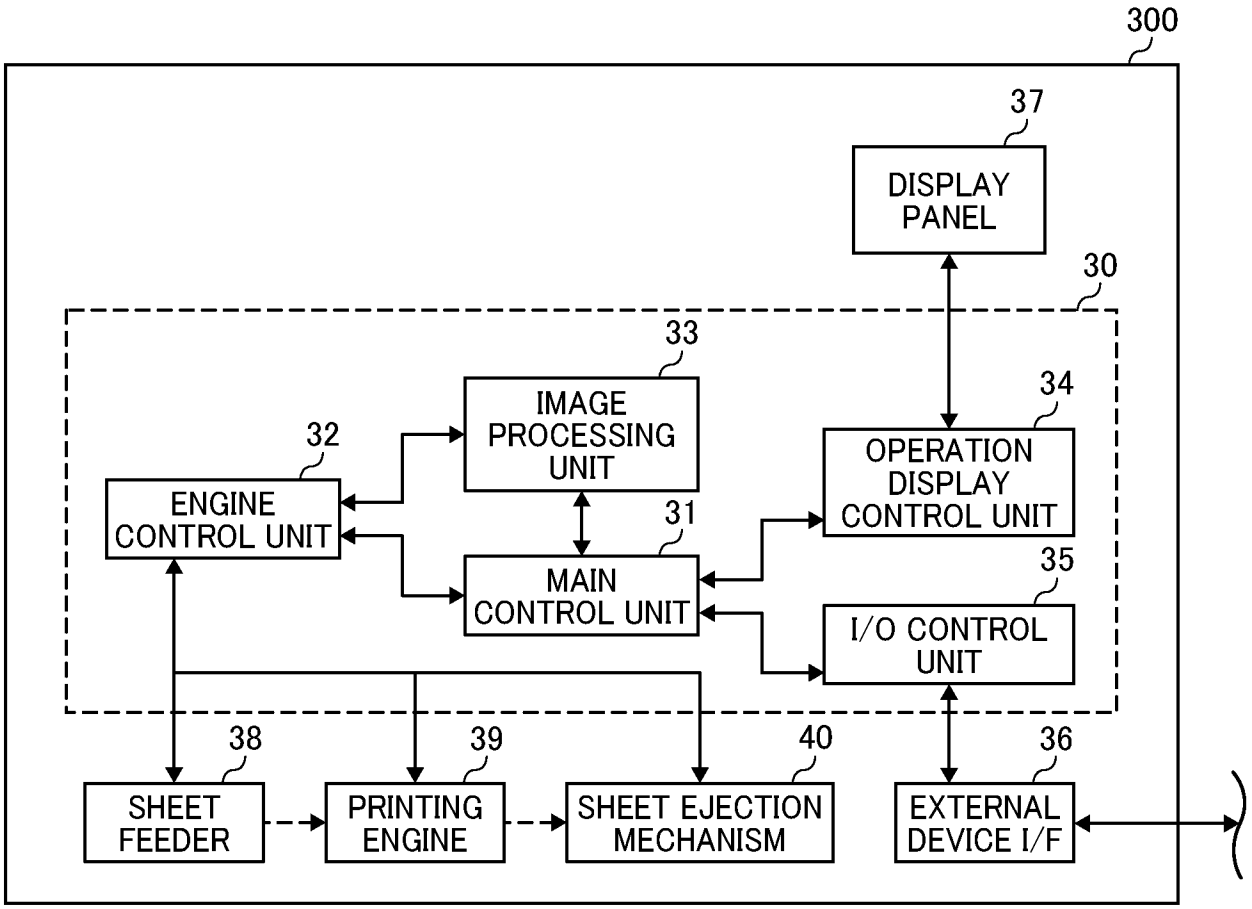
FIG. 3 is a block diagram of the image forming apparatus illustrated in FIG. 1.

Descriptions are given below of a functional configuration of the image forming apparatus 300 that provides main functions in the image forming system 1000. FIG. 3 is a block diagram of the image forming apparatus 300. As illustrated in FIG. 3, the image forming apparatus 300 includes a controller 30, a display panel 37, a sheet feeder 38, a printing engine 39, a sheet ejection mechanism 40, and an external device I/F 36. It is to be noted that, in FIG. 3, solid lines represent electrical connections, and broken lines represent flow of the continuous sheet 101 being a recording medium.

The display panel 37 serves as both of an output interface to visually display the state of the image forming apparatus 300 and an input interface (i.e., a control panel) such as a touch panel for users to directly operate the image forming system 1000 or input information into the image forming apparatus 300.

The external device I/F 36 is an interface for communication with other devices via the network or a device connection cable, and for example, Ethernet (registered trademark) or universal serial bus (USB) interface is used.

The controller 30 includes a main control unit 31, an engine control unit 32, an image processing unit 33, an operation display control unit 34, and an input and output (I/O) control unit 35. The controller 30 is implemented by a combination of software and hardware.

Specifically, a control program (e.g., firmware) stored in the ROM 303, a non-volatile memory, or a non-volatile storage medium, such as the HDD 305 and an optical disc, is loaded to a volatile memory, such as the RAM 302. The controller 30 is implemented by the software control unit controlled by the CPU 301 and hardware, such as an integrated circuit. The controller 30 controls the overall image forming system 1000.

The main control unit 31 controls each unit of the controller 30. The main control unit 31 gives instructions to each unit in the controller 30. The engine control unit 32 controls or drives the printing engine 39.

The I/O control unit 35 inputs signals and commands received via the external device OF 36 to the main control unit 31. In addition, the main control unit 31 controls the I/O control unit 35 to access, via the external device I/F 36, to other devices (the sheet feeder 100, the pretreatment apparatus 200, the post-processing apparatus 400, the winder 500, a print job transmission device, and the like).

Controlled by the main control unit 31, the image processing unit 33 generates drawing data based on print data included in the print job. The drawing data is data for the printing engine 39 (i.e., an image forming unit) to draw images to be formed in image formation. The operation display control unit 34 displays information on the display panel 37 or reports, to the main control unit 31, information input via the display panel 37.

In the image forming system 1000, first, the I/O control unit 35 receives a print job instructing execution of image formation via the external device I/F 36. The I/O control unit 35 transmits the received print job to the main control unit 31. In response to the print job, the main control unit 31 causes the image processing unit 33 to generate drawing data according to the print data included in the print job.

According to the drawing data generated by the image processing unit 33, the engine control unit 32 executes image formation on the continuous sheet 101 transported from the sheet feeder 38. The sheet ejection mechanism 40 discharged the continuous sheet 101 on which an image is formed by the printing engine 39 to the stage subsequent to the image forming apparatus 300.

Figure 4:
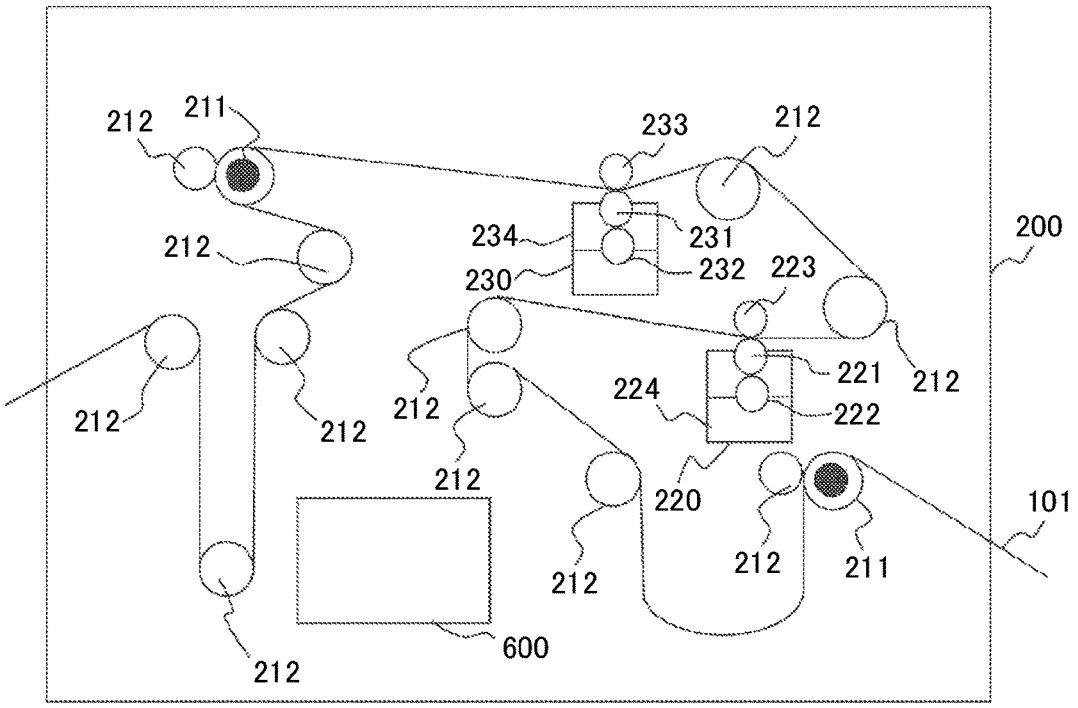
FIG. 4 is a diagram illustrating an internal configuration of a pretreatment apparatus according to an embodiment of the present disclosure.

Next, the pretreatment apparatus 200 will be described with reference to FIG. 4. FIG. 4 is a diagram for explaining an internal configuration of the pretreatment apparatus 200 illustrated in FIG. 1. As illustrated in FIG. 4, the pretreatment apparatus 200 is a liquid application apparatus that applies a treatment liquid for accelerating the aggregation of ink, which is a material for forming an image on the continuous sheet 101. The treatment liquid is applied to each of the front side and the back side of the continuous sheet 101. Therefore, the pretreatment apparatus 200 includes a front-side application device 220 to apply the treatment liquid onto the front side and a back-side application device 230 to apply the treatment liquid onto the back side. The pretreatment apparatus 200 further includes a liquid supply device 600 that supplies the treatment liquid to each of the front-side application device 220 and the back-side application device 230 and draws away the treatment liquid when the treatment liquid is not applied. A detailed description of the liquid supply device 600 is given later.

As illustrated in FIG. 4, the pretreatment apparatus 200 includes a conveyance device including a plurality of conveyance rollers, which defines a conveyance passage inside the pretreatment apparatus 200. Through the conveyance passage, the continuous sheet 101 is conveyed in a predetermined direction inside the pretreatment apparatus 200. The conveyance device of the pretreatment apparatus 200 includes two drive rollers 211, eleven driven rollers 212 that abut on the continuous sheet 101 and rotate in the direction of conveyance of the continuous sheet 101, and a driver to rotate the drive roller 211. The drive rollers 211 and the driven rollers 212 define the conveyance passage in the pretreatment apparatus 200. The continuous sheet 101 is conveyed through the conveyance passage from the sheet feeder 100 toward the image forming apparatus 300. In the pretreatment apparatus 200, the front-side application device 220 is disposed on the upstream side and the back-side application device 230 is disposed on the downstream side along the conveyance passage.

The front-side application device 220 includes a front-side application roller 221, a front-side squeeze roller 222, a front-side pressure roller 223, and a front-side liquid pan 224, and stores the treatment liquid kept in a state applicable to the continuous sheet 101. The front-side application roller 221 is a cylindrical member, and the front-side squeeze roller 222 transfers the treatment liquid to the front-side application roller 221 in a thin film. The front-side pressure roller 223 sandwiches the continuous sheet 101 with the front-side application roller 221 and presses the continuous sheet 101 toward the front-side application roller 221 and the front-side squeeze roller 222. The front-side liquid pan 224 serves as a liquid reservoir to store the treatment liquid below the front-side squeeze roller 222. The front-side squeeze roller 222 is in contact with the treatment liquid stored in the front-side liquid pan 224 and rotates to draw up the treatment liquid and apply the treatment liquid to the front-side application roller 221.

After the front-side application device 220 applies the treatment liquid to the front side of the continuous sheet 101, the treatment liquid is also applied to the back side thereof by the back-side application device 230 disposed on the conveyance passage.

The back-side application device 230 has the same configuration as the front-side application device 220 and includes a back-side application roller 231, a back-side squeeze roller 232, a back-side pressure roller 233, a back-side liquid pan 234 serving as a liquid reservoir. Similar to the front-side application device 220, the treatment liquid is stored in a state applicable to the continuous sheet 101. The front-side application device 220 and the back-side application device 230 are removable from the pretreatment apparatus 200.

The front-side application device 220 and the back-side application device 230 are coupled to the liquid supply device 600, respectively, and the liquid supply device 600 supplies the treatment liquid to the front-side liquid pan 224 and the back-side liquid pan 234.

Figure 5:
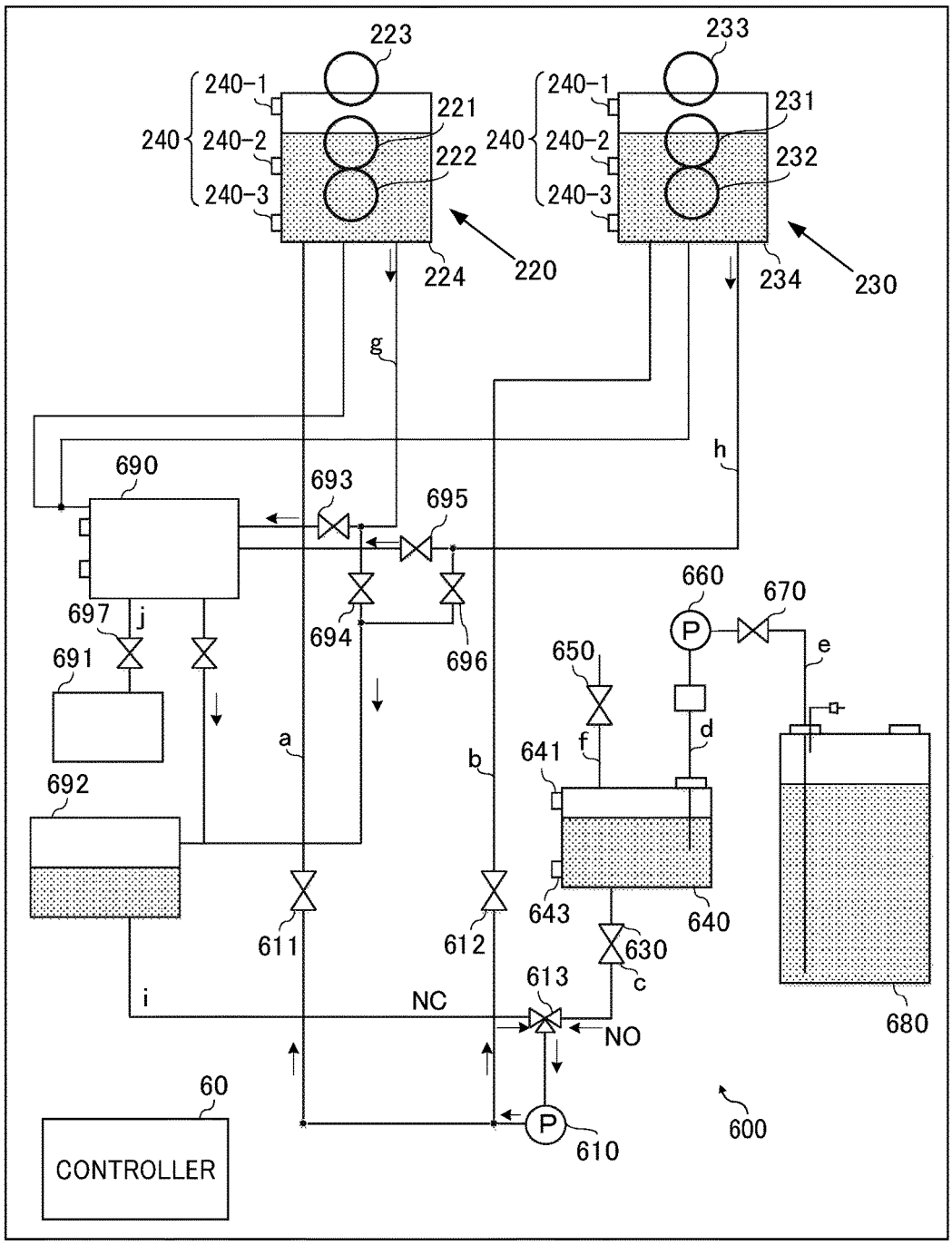
FIG. 5 is a schematic view of a liquid supply device according to an embodiment.

Next, the liquid supply device 600 will be described with reference to FIG. 5. FIG. 5 is a schematic cross-sectional view of the liquid supply device 600. The liquid supply device 600 supplies the treatment liquid to the front-side application device 220 and the back-side application device 230 so that the treatment liquid is applied to the entire front surface and the entire back surface of the continuous sheet 101 transported inside the pretreatment apparatus 200. Further, the liquid supply device 600 supplies the treatment liquid to the front-side liquid pan 224 and the back-side liquid pan 234 as required.

The liquid supply device 600 has a structure to supply the treatment liquid to the front-side liquid pan 224 and the back-side liquid pan 234. That is, the liquid supply device 600 includes a sub tank 640 (e.g., a small capacity tank) which is a first tank, a main tank 680 which is a second tank, a main pump 610, and a sub pump 660. The main pump 610 is a first pump to convey the treatment liquid from the sub tank 640 to the front-side liquid pan 224 and the back-side liquid pan 234. The sub pump 660 is a second pump to convey the treatment liquid from the main tank 680 to the sub tank 640.

The liquid supply device 600 includes a controller 60 to control opening and closing of solenoid valves described later and the operations of the main pump 610 and the sub pump 660. The controller 60 is electrically connected to the devices to be controlled by the controller 60, such as the solenoid valves and the sub pump 660. In FIG. 5, for convenience of explanation, the electrical connection of the controller 60 is omitted.

The sub tank 640 keeps a high degree of airtightness of the interior thereof and can keep the treatment liquid held in the sub tank 640 in a fresh state. Therefore, in either case of discharging the treatment liquid from the sub tank 640 (for liquid supply) or receiving the treatment liquid into the sub tank 640 (for replenishing the sub tank 640), the interior of the sub tank 640 is made to communicate with the atmosphere. Therefore, the sub tank 640 includes an airflow path f to communicate the interior of the sub tank 640 with the outside and an air-release solenoid valve 650 to open or close the airflow path f.

The main tank 680 stores the treatment liquid to be supplied to the sub tank 640. The treatment liquid stored in the main tank 680 is the same as the treatment liquid supplied to the front-side application device 220 and the back-side application device 230. A predetermined amount of treatment liquid is preliminarily sent from the main tank 680 to the sub tank 640. The predetermined amount can be determined empirically by a manufacturer.

The liquid supply device 600 has a plurality of supply passages for conveying the treatment liquid. The supply passages of the liquid supply device 600, valves to open and close the supply passages, and a pump that provides power to convey the treatment liquid together construct supply sections for the treatment liquid.

Specifically, a first supply section includes the sub pump 660, a supply passage c from the sub tank 640 to the sub pump 660, a solenoid valve 630 to open and close the supply passage c, a supply passage a for the treatment liquid sent from the main pump 610 to the front-side liquid pan 224, a solenoid valve 611 to open and close the supply passage a, a supply passage b for the treatment liquid sent from the main pump 610 to the back-side liquid pan 234, and a solenoid valve 612 to open and close the supply passage b.

Further, a second supply section includes the sub pump 660, a supply passage e from the main tank 680 to the sub pump 660, a solenoid valve 670 to open and close the supply passage e, and a supply passage d from the sub pump 660 to the sub tank 640.

Each of the front-side liquid pan 224 and the back-side liquid pan 234 includes liquid level sensors 240 (240-1, 240-2, and 240-3) to detect a surface position (liquid level) of the treatment liquid held therein, disposed at plurality of different locations. The liquid level sensors 240 are installed, at least, at three different positions spaced apart by a predetermined distance in the gravitational direction of the front-side liquid pan 224 and the back-side liquid pan 234. For example, each of the front-side liquid pan 224 and the back-side liquid pan 234 includes a top liquid level sensor 240-1 to detect that the treatment liquid is stored up to a top level, a middle liquid level sensor 240-2 to detect that the treatment liquid has decreased by application to the continuous sheet 101, and a lower liquid level sensor 240-3 to detect that no (or almost no) treatment liquid is stored at a lowest position.

For example, each liquid level sensor 240 continues to output a detection signal when the liquid level of the treatment liquid is at the detection position and stops outputting the detection signal when the treatment liquid is not detected. As illustrated in FIG. 5, when the liquid surface of the treatment liquid is above the middle liquid level sensor 240-2 installed at the middle height position of each of the front-side liquid pan 224 and the back-side liquid pan 234, the detection signals are output from the middle liquid level sensor 240-2 and the lower liquid level sensor 240-3. When the liquid level of the treatment liquid is below the middle liquid level sensor 240-2, the detection signal is not output from the middle liquid level sensor 240-2 but is output from the lower liquid level sensor 240-3. In response to detection of this state, the controller 60 starts feeding of the treatment liquid from the sub tank 640. Therefore, depending on the presence or absence of the detection signal from the middle liquid level sensor 240-2, the controller 60 can determine the supply timing of the treatment liquid from the sub tank 640 to the front-side liquid pan 224 and the back-side liquid pan 234.

When the treatment liquid is supplied from the sub tank 640 to the front-side liquid pan 224 and the back-side liquid pan 234, the treatment liquid held in the sub tank 640 decreases. Therefore, the controller 60 replenishes the sub tank 640 with the treatment liquid from the main tank 680 before the sub tank 640 becomes empty. Differently from the front-side liquid pan 224 and the back-side liquid pan 234, the sub tank 640 includes liquid level sensors only at two height positions (top and lower levels). That is, the sub tank 640 includes a top liquid level sensor 641 and a lower liquid level sensor 643 installed at a top level and a lowest level, respectively. That is, no sensor is installed at a middle height position. Similar to the top liquid level sensor 240-1 and the lower liquid level sensor 240-3, the top liquid level sensor 641 and the lower liquid level sensor 643 continue to output the detection signal when the treatment liquid is at that position and stops outputting the detection signal when the treatment liquid is not detected.

In the liquid supply device 600 having the above configuration, opening of the solenoid valve 630, operating the sub pump 660, opening the air-release solenoid valve 650 to feed the treatment liquid to the front-side liquid pan 224 and the back-side liquid pan 234 from the sub tank 640 are performed as a first supply operation. That is, the supply of the treatment liquid by the first supply section is defined as the first supply operation in the liquid supply device 600.

Further, opening the solenoid valve 670, operating the sub pump 660, and opening the air-release solenoid valve 650 to feed the treatment liquid from the main tank 680 to the sub tank 640 are performed as a second supply operation. That is, the supply of the treatment liquid by the second supply section is defined as the second supply operation in the liquid supply device 600.

In addition to the above-described configuration and operation, the liquid supply device 600 further includes a reserve tank 690 to temporarily store the treatment liquid, and a filter 692 to remove foreign substances contained in the treatment liquid in the front-side liquid pan 224 and the back-side liquid pan 234 during application of the treatment liquid onto the continuous sheet 101.

As a passage leading to the reserve tank 690 and the filter 692, the liquid supply device 600 includes a retreat and circulation passage g leading from the front-side liquid pan 224 to the reserve tank 690 and the filter 692, and a retreat and circulation passage h leading from the back-side liquid pan 234 to the reserve tank 690 and the filter 692, and a circulation passage i leading from the filter 692 to the sub pump 660.

Further, the retreat and circulation passage g is provided with a solenoid valve 693 to open and close a retreat passage on the side of the reserve tank 690 and a solenoid valve 694 to open and close a circulation passage on the side of the filter 692. The retreat and circulation passage h is provided with a solenoid valve 695 to open and close a retreat passage on the side of the reserve tank 690 and a solenoid valve 696 to open and close a circulation passage on the side of the filter 692.

A solenoid valve 613 is installed at the junction between the supply passage c and the circulation passage i. As the solenoid valve 613 is opened, the supply passage c connecting the main pump 610 and the sub tank 640 is opened. Further, as the solenoid valve 613 is closed, the circulation passage i connecting the main pump 610 and the filter 692 is opened.

The liquid supply device 600 further includes a waste liquid tank 691 for discarding the treatment liquid, a waste liquid passage j leading from the reserve tank 690 to the waste liquid tank 691, and a solenoid valve 697 to open and close the waste liquid passage j.

The front-side liquid pan 224 is shaped to cover the front-side application roller 221 and the front-side squeeze roller 222, prevent evaporation of the stored treatment liquid, and suppress deterioration of the treatment liquid due to the contact with air. In addition, the back-side liquid pan 234 is shaped to cover the back-side application roller 231 and the back-side squeeze roller 232, prevent evaporation of the stored treatment liquid, and suppress deterioration of the treatment liquid due to the contact with air.

Note that the front-side liquid pan 224 is open in a portion where the front-side application roller 221 is pressed against the front-side pressure roller 223, and the back-side liquid pan 234 is open in the portion where the back-side application roller 231 is pressed against the back-side pressure roller 233. Therefore, the front-side liquid pan 224 and the back-side liquid pan 234 are not fully sealed. Therefore, the liquid supply device 600 includes the reserve tank 690 that is higher in airtightness than the front-side liquid pan 224 and the back-side liquid pan 234.

The reserve tank 690 is used to temporarily withdraw the treatment liquid from the front-side liquid pan 224 and the back-side liquid pan 234 when the image forming operation for consuming the treatment liquid is stopped for a certain period of time or when the power of the image forming apparatus 300 or the pretreatment apparatus 200 is turned off.

Withdrawal of the treatment liquid to the reserve tank 690 utilizes a hydraulic head difference between the front-side liquid pan 224 and the reserve tank 690 and between the back-side liquid pan 234 and the reserve tank 690. Therefore, in the liquid supply device 600, the reserve tank 690, the front-side application device 220, and the back-side application device 230 are arranged so that the front-side liquid pan 224 and the back-side liquid pan 234 are positioned higher than the liquid level in the reserve tank 690. As the solenoid valve 693 in the retreat and circulation passage g and the solenoid valve 695 in the retreat and circulation passage h are opened, the treatment liquid is withdrawn to the reserve tank 690 due to the hydraulic head difference.

Owing to the reserve tank 690, deterioration of the treatment liquid stored in the front-side liquid pan 224 and the back-side liquid pan 234 can be suppressed.

Next, an example of the operation of the liquid supply device 600 will be described. First, descriptions are given below of an example in which the image forming system 1000 restarts operation when the pretreatment apparatus 200 or the image forming apparatus 300 is powered on and after the operations of the apparatuses are stopped for a certain period of time. When the image forming system 1000 is stopped for a certain period of time, the treatment liquid in the front-side liquid pan 224 and the back-side liquid pan 234 is withdrawn to the reserve tank 690. Therefore, when restarting the operation, first, the main pump 610 is driven to feed the treatment liquid from the sub tank 640 to the front-side liquid pan 224 and the back-side liquid pan 234.

As already explained, to grasp the liquid surface position (level of amount of treatment liquid stored) in the front-side liquid pan 224 and the back-side liquid pan 234, the liquid level sensors 240 are disposed in several height intervals. When the top liquid level sensors 240-1 disposed at the top level of the front-side liquid pan 224 and the back-side liquid pan 234 are sensing the treatment liquid, the operation of the main pump 610 is stopped, thereby stopping supply of the treatment liquid to the front-side liquid pan 224 and the back-side liquid pan 234.

As the treatment liquid is sent to the front-side liquid pan 224 and the back-side liquid pan 234 by the sub pump 660, the treatment liquid held by the sub tank 640 decreases. As a result, the top liquid level sensor 641 installed at the top level of the sub tank 640 stops outputting the detection signal. Triggered by the stop of the detection signal, the second supply operation is started to send the treatment liquid from the main tank 680 to the sub tank 640.

The description above is the supply of the treatment liquid to the front-side liquid pan 224 and the back-side liquid pan 234 when the pretreatment apparatus 200 or the image forming apparatus 300 is powered on and after the operation has been stopped for a specified time. This supply operation is performed when the image forming apparatus 300 is not forming an image (non-printing period). The image forming apparatus 300 is ready for image formation when the treatment liquid is stored to the top level or greater in each of the front-side liquid pan 224, the back-side liquid pan 234, and the sub tank 640.

Next, as another example, descriptions are given below of operation of the liquid supply device 600 performed during image forming in the image forming apparatus 300, that is, when the treatment liquid is gradually consumed in the pretreatment apparatus 200. As described above, at the start of image formation, the level of the treatment liquid in each of the front-side liquid pan 224, the back-side liquid pan 234, and the sub tank 640 is at the top level. However, as the treatment liquid is applied to the continuous sheet 101 and gradually consumed inherent to progress of image formation, the amount of the treatment liquid stored in the front-side liquid pan 224 and the back-side liquid pan 234 decreases, and the liquid surface therein drops.

For example, as illustrated in FIG. 5, stop of detection signal from the middle liquid level sensor 240-2 of the front-side liquid pan 224 or the back-side liquid pan 234 is used as a trigger to start the first supply operation to supply the treatment liquid to the front-side liquid pan 224 and the back-side liquid pan 234. That is, the main pump 610 is driven to send the treatment liquid, and the first supply operation is continued until the top liquid level sensor 240-1 disposed at the top level starts detecting the treatment liquid (until the detection signal is output). The lower liquid level sensors 240-3 installed at the lowest level of the front-side liquid pan 224 and the back-side liquid pan 234 normally keep detecting the liquid. The lower liquid level sensors 240-3 are used to detect defective supply of treatment liquid due to malfunction of the supply system or the like.

In addition, as the treatment liquid is supplied from the sub tank 640 to the front-side liquid pan 224 and the back-side liquid pan 234, the treatment liquid held by the sub tank 640 decreases. Therefore, the treatment liquid is supplied to the sub tank 640. In the liquid supply device 600 according to the present embodiment, the second supply operation is not triggered by the stop of detection signal from the top liquid level sensor 641 installed at the top level but is started based on the drive time of the sub pump 660. The controller 60 drives the sub pump 660 and continues the second supply operation until the top liquid level sensor 641 at the top level outputs the detection signal.

Note that the lower liquid level sensor 643 installed in the sub tank 640 normally keeps detecting the liquid. The lower liquid level sensor 643 is used to detect defective supply of treatment liquid from the main tank 680 to the sub tank 640 due to some abnormality.

In the liquid supply device 600, the airflow path f in the upper part of the sub tank 640 is opened at the time of feeding the treatment liquid from the sub tank 640 to the front-side liquid pan 224 and the back-side liquid pan 234 and at the time of sending the treatment liquid from the main tank 680 to the sub tank 640. When the airflow path f is open, the treatment liquid retained in the sub tank 640 contacts the atmosphere, and the treatment liquid deteriorates. Therefore, the opening time of the airflow path f is kept as short as possible. Therefore, in the liquid supply device 600, in a state in which the pretreatment apparatus 200 operates to consume the treatment liquid, the controller 60 synchronizes the start of the first supply operation for supplying the treatment liquid to the front-side liquid pan 224 and the back-side liquid pan 234 with the start of the second supply operation for supplying the treatment liquid to the sub tank 640 (supply to sub tank). That is, the controller 60 synchronizes the operation timings of the sub pump 660, the sub pump 660, and the air-release solenoid valve 650 with each other based on a predetermined condition.

Description are given in detail of supply of the treatment liquid by the liquid supply device 600. First, the controller 60 stores, for example, in the RAM 302, the operation time of supply (the first supply operation) of the treatment liquid from the sub tank 640 to the front-side liquid pan 224 and the back-side liquid pan 234, that is, the cumulative operation time of the sub pump 660. Each time the operation time elapses a predetermined time T1, the controller 60 keeps the second supply section in a state ready for the supply (second supply operation) of the treatment liquid from the main tank 680 to the sub tank 640. Further, the timing to start the second supply operation is synchronized with the timing of start of next first supply operation after the lapse of the predetermined time T1. In other words, after the cumulative operation time of the main pump 610 has exceeded the predetermined time T1, when the middle liquid level sensor 240-2 of one or both of the front-side liquid pan 224 and the back-side liquid pan 234 stops detecting the treatment liquid, the main pump 610 is started and simultaneously the sub pump 660 is operated. Further, the air-release solenoid valve 650 is operated to open the airflow path f.

Such control can shorten the operation time of the main pump 610 and the sub pump 660 per unit time and shorten the time during which the air-release solenoid valve 650 is open. In other words, the time during which the treatment liquid in the sub tank 640 contacts the atmosphere can be shortened. With this control, the deterioration of the treatment liquid can be suppressed, and the deterioration of printing quality can be suppressed.

Figure 6:
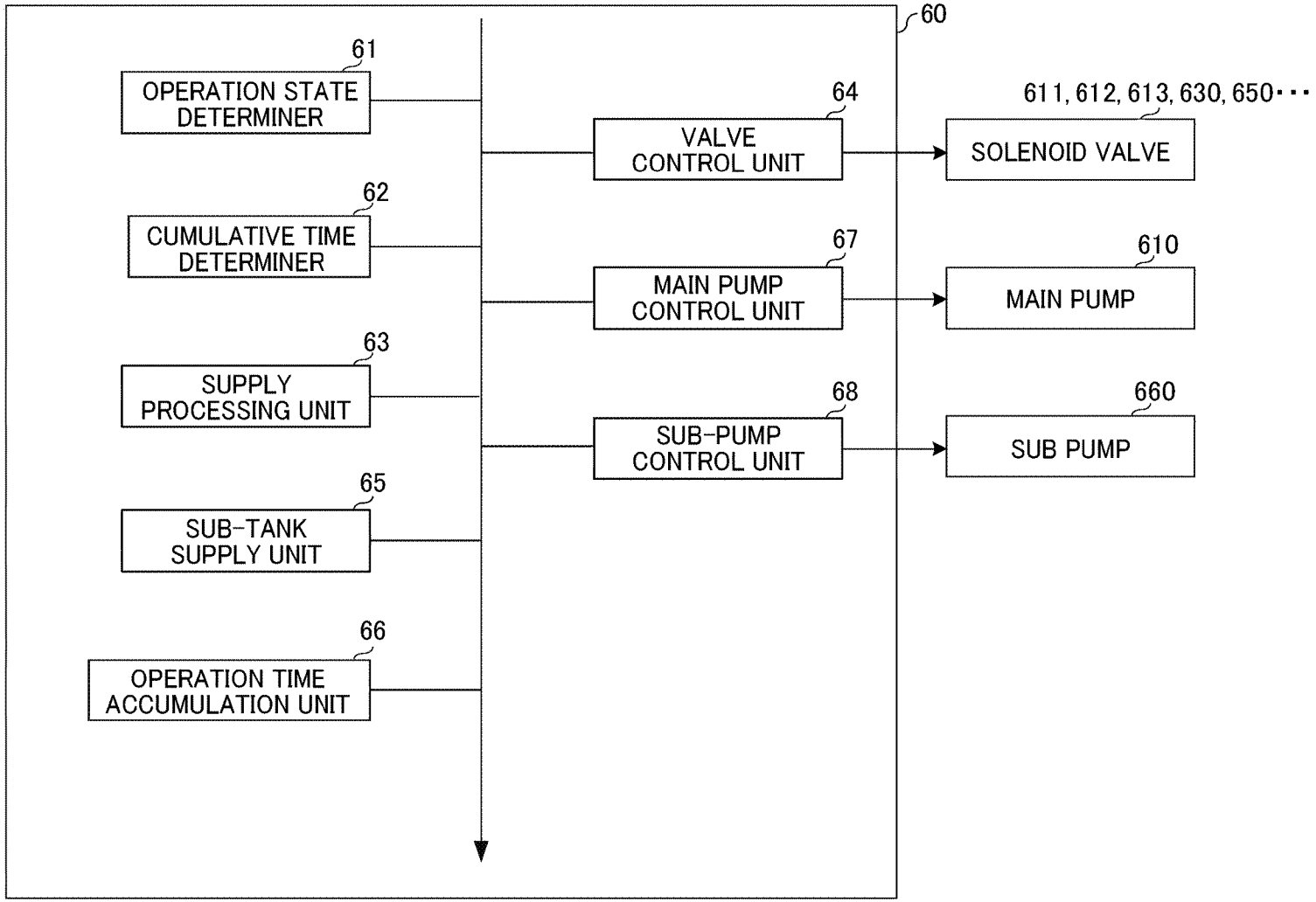
FIG. 6 is a functional block diagram of a controller of the liquid supply device illustrated in FIG. 5.

Next, a configuration of the controller 60 to control the supply operation will be described with reference to FIG. 6. The controller 60 includes an operation state determiner 61, a cumulative time determiner 62, a supply processing unit 63, a valve control unit 64, a sub-tank supply unit 65, an operation time accumulation unit 66, a main pump control unit 67, and a sub-pump control unit 68. The above-described components of the controller 60 are functional blocks constructed by the cooperation of the hardware illustrated in FIG. 13 and software for realizing the functions of the components. Alternatively, the processing of the controller 60 to control the supply operation can be executed by the controller 30 of the image forming apparatus 300.

The operation state determiner 61 determines the operation state of the pretreatment apparatus 200 and the image forming apparatus 300. When the image forming apparatus 300 is executing the image formation in the image forming system 1000, the pretreatment apparatus 200 applies the treatment liquid to the continuous sheet 101 (recording medium) and conveys the continuous sheet 101. That is, the operation state determiner 61 determines whether the pretreatment apparatus 200 or the image forming apparatus 300 is operating (whether power is on), whether image formation is ongoing, whether stop time of the pretreatment apparatus 200 or the image forming apparatus 300 exceeds a predetermined time, or the like.

The cumulative time determiner 62 determines whether or not the cumulative operation time of the main pump 610 calculated by the operation time accumulation unit 66 exceeds a threshold (predetermined time T1) stored in a memory. When the cumulative operation time exceeds the predetermined time T1, the cumulative time determiner stores, for example, in a memory, information of exceeding of the cumulative operation time as a frag (operation start flag information).

The supply processing unit 63 controls the supply operation of the treatment liquid from the sub tank 640 to the front-side liquid pan 224 and the back-side liquid pan 234. More specifically, based on the detection signal from the liquid level sensor 240 installed in the front-side liquid pan 224 and the back-side liquid pan 234, the supply processing unit 63 determines whether or not to operate the sub pump 660. Further, the supply processing unit 63 sends, to the valve control unit 64, an instruction for opening or closing the air-release solenoid valve 650.

The valve control unit 64 controls opening and closing of each solenoid valve. The valve control unit 64 opens the air-release solenoid valve 650 disposed in the upper portion of the sub tank 640, for example, based on instructions to the pumps from the supply processing unit 63 and the sub-tank supply unit 65.

The sub-tank supply unit 65 controls supply of the treatment liquid from the main tank 680 to the sub tank 640. More specifically, based on the operation start flag information by the cumulative time determiner 62 and the supply process start timing in the supply processing unit 63, the sub-tank supply unit 65 determines whether or not to operate the sub pump 660.

The operation time accumulation unit 66 calculates and holds the cumulative operation time of the sub pump 660. When the sub-pump control unit 68 operates the sub pump 660, the operation time accumulation unit 66 resets the cumulative time.

The main pump control unit 67 controls the operation of the main pump 610 based on the determination result by the supply processing unit 63.

The sub-pump control unit 68 controls the operation of the sub pump 660 based on the determination result by the sub-tank supply unit 65.

Next, an example liquid supply method executable in the liquid supply device 600 will be described. A comparative example to be compared with the liquid supply method by the liquid supply device 600 will first be described with reference to FIG. 7. The comparative liquid supply device includes a small capacity tank (corresponding to the sub tank 640), and the small capacity tank includes at least one sensor to detect the liquid level of the treatment liquid between a top level and a lowest level, differently from the sub tank 640 of the liquid supply device 600. In other words, the comparative liquid supply device is configured to detect the remaining amount of the treatment liquid in the small capacity tank and supply the treatment liquid to the tank at a unique timing.

Figure 7:
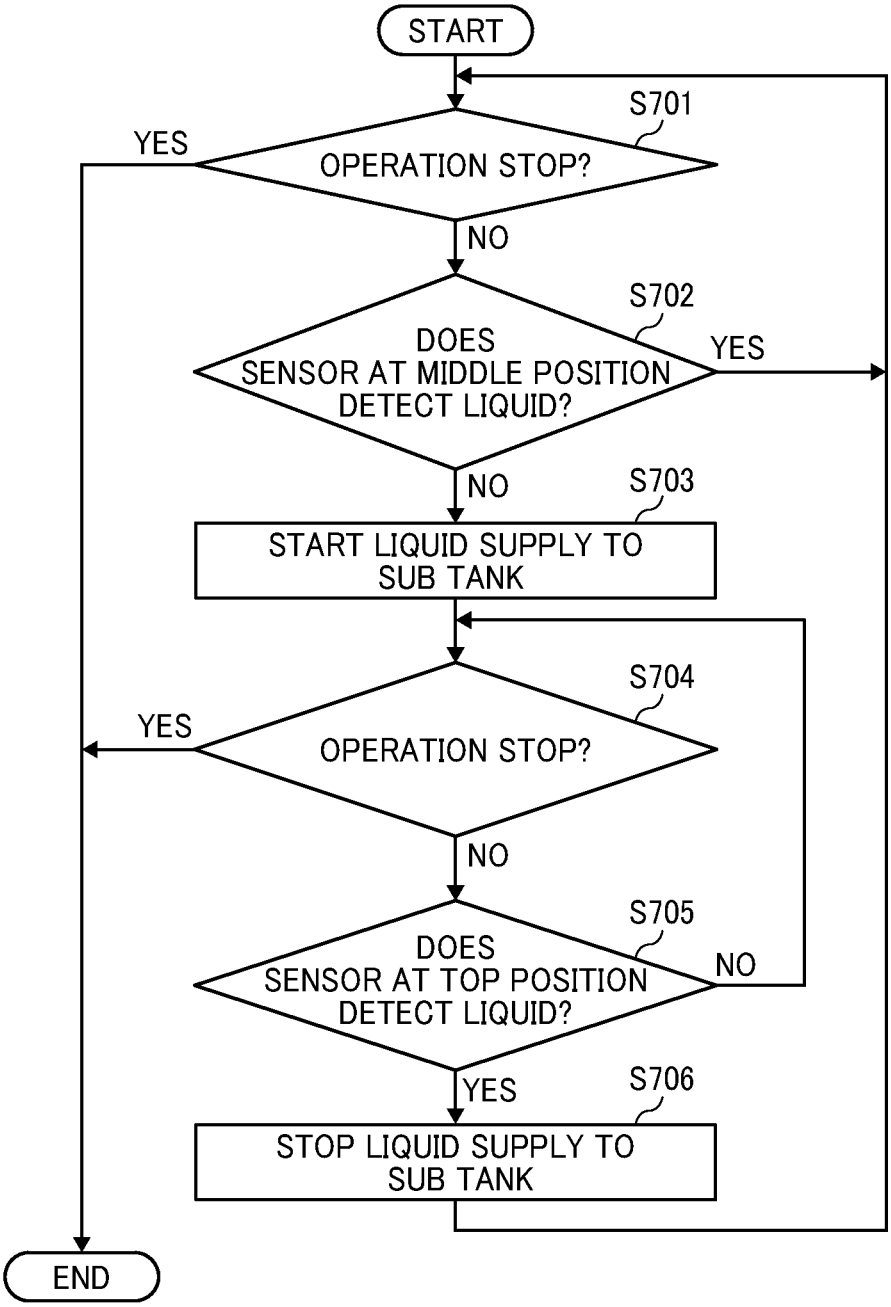
FIG. 7 is a flowchart illustrating a liquid supply method in a comparative liquid supply device.

FIG. 7 illustrates an example comparative liquid supply method, in which, during image formation by the image forming apparatus, the treatment liquid is supplied to the small capacity tank (a sub tank supply operation). First, in order to determine whether or not supply of the treatment liquid is necessary, the comparative liquid supply device determines whether or not the image forming apparatus with which the comparative liquid supply device is geared is in a stop state (S701). In S701, in response to a determination that the apparatus is in the stop state (Yes in S701), the sub tank supply operation is ended.

In response to a determination that the apparatus is in operation (No in S701), in S701, the comparative liquid supply device determines whether or not the sensor at the middle position of the small capacity tank is sensing the treatment liquid (S702). In S702, when the sensor detects the treatment liquid (Yes in S702), the process returns to S701.

In S702, when the sensor does not detect the treatment liquid (No in S702), the treatment liquid supply to the small capacity tank (sub tank supply) is started (S703). In S703, a pump (sub pump) for feeding the treatment liquid to a small capacity tank is driven. At the same time as driving the sub pump at S703, a pump (main pump) for feeding the treatment liquid from the small capacity tank is driven. Additionally, at the same time as the main pump is driven, an air release valve of the small capacity tank is opened.

Next, similar to S701, the liquid supply device determines whether or not the operation of the image forming apparatus or the like with which the device is geared is in a stop state (S704). In S704, in response to a determination that the apparatus is in the stop state (Yes in S704), the sub tank supply operation is ended.

In response to a determination that the apparatus is in operation in S704 (No in S704), the liquid supply device determines whether or not the sensor installed at the top level of the small capacity tank detects the treatment liquid (S705). In S705, when the sensor does not detect the treatment liquid (No in S705), the process returns to S704.

In S705, when the sensor at the top level detects the treatment liquid (Yes in S705), the operation of the sub pump is stopped (S706), stopping the liquid supply to the sub tank, and the process returns to S701. At this time, when driving of the main pump has ended, the air release valve is closed to shut off the tank from the atmosphere.

Figure 8:
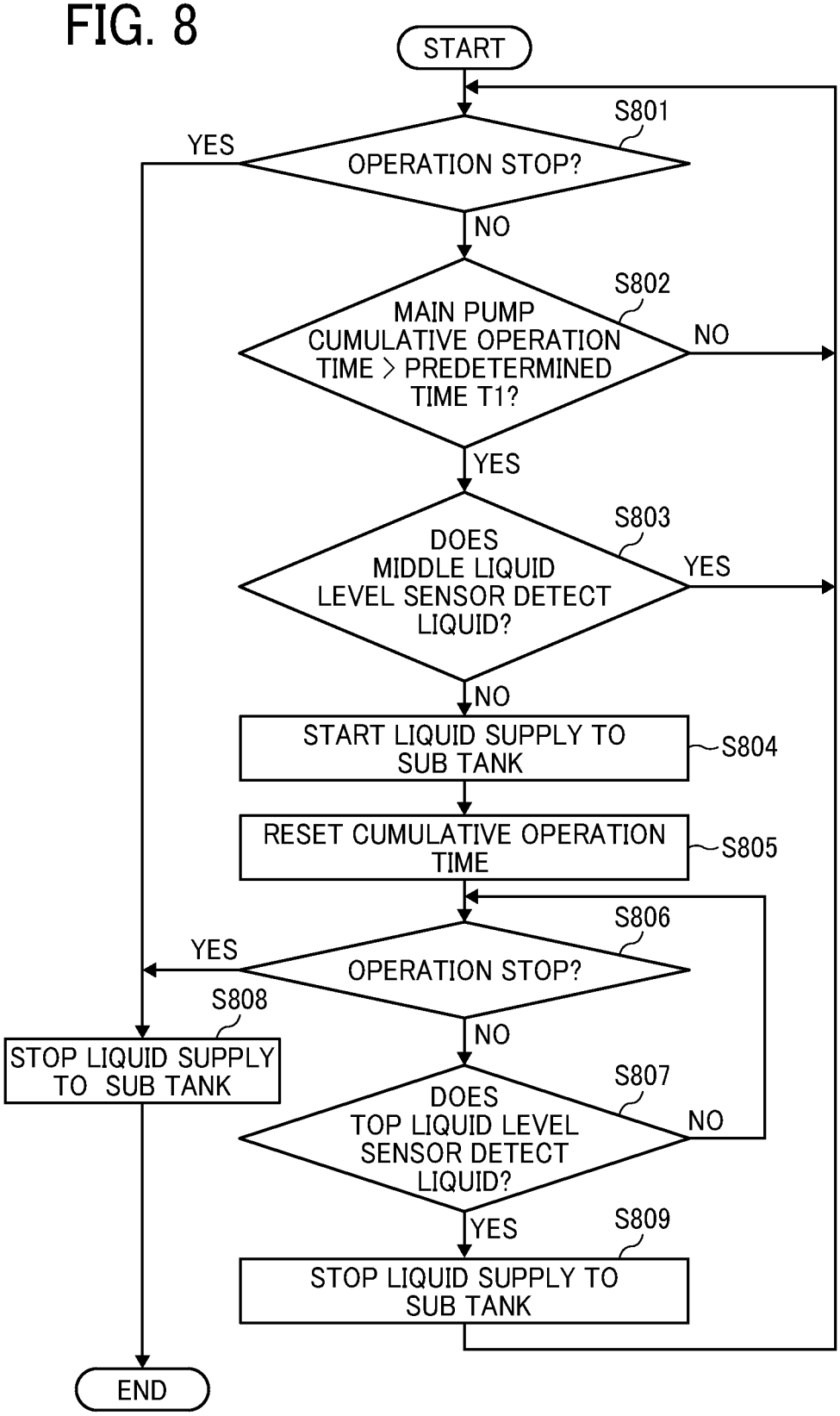
FIG. 8 is a flowchart illustrating a flow of processing by the liquid supply device illustrated in FIG. 5.

FIG. 8 is a flowchart illustrating an example liquid supply method executed in the liquid supply device 600 according to the present embodiment.

The liquid supply method is executed while the image forming system 1000 executes image formation. First, the controller 60 determines whether the image forming apparatus 300 or the like is in a stop state (S801). In response to a determination that the apparatus is in a stop state (Yes in S801), at S808, the controller 60 stops supply of the treatment liquid (first supply operation) by the main pump 610 (the first pump) from the sub tank 640 (the first tank) to the front-side liquid pan 224 and the back-side liquid pan 234 in the liquid supply device 600 and ends the process.

By contrast, in response to a determination that the image forming apparatus 300 or the like is in operation (No in S801), since the first supply operation is ongoing, the main pump 610 is operating. Therefore, the cumulative time determiner 62 determines whether or not the cumulative operation time of the main pump 610 (the main pump) has exceeded the predetermined time T1 (S802). In response to a determination that the cumulative operation time of the main pump 610 has not exceeded the predetermined time T1 (No in S802), the process returns to S801.

Here, the "predetermined time T1" will be described in detail. The predetermined time T1 is a threshold for the cumulative operation time. If the threshold is too small (too short as a time period), the second supply operation (supply to sub tank) is frequently executed. When the second supply operation is frequently executed, the treatment liquid held in the sub tank 640 does not mix well and the components of the treatment liquid held in the sub tank 640 are separated, which is unfavorable.

On the contrary, when the threshold is too large (the time period is too long), the period during which the second supply operation is not executed is long, and the old treatment liquid is mixed in a rush with the new treatment liquid inside the sub tank 640. In this case, the treatment liquid is unevenly applied to the continuous sheet 101. In addition, as the proportion of air occupied in the treatment liquid held in the sub tank 640 increases, undesirably, the treatment liquid can become thicker.

Therefore, the predetermined time T1 as the threshold is set to satisfy the predetermined condition. For example, the predetermined time T1 is preferably longer than a period (first time) required to consume about 20% of a maximum supply amount of the treatment liquid from the sub tank 640 to the front-side liquid pan 224 and the back-side liquid pan 234. In addition, the predetermined time T1 is preferably shorter than a period (second time) required to consume about 40% of maximum of the amount of the treatment liquid (liquid supply amount) supplied from the sub tank 640 to the front-side liquid pan 224 and the back-side liquid pan 234.

Therefore, the predetermined time T1 is longer than the time required for consumption of about 20% of the maximum of the supply amount of the treatment liquid supplied in the first supply operation and shorter than the time required for consumption of about 40% of the supply amount in the first supply operation.

Return to FIG. 8, when the cumulative operation time of the main pump 610 has exceeded the predetermined time T1 (Yes in S802), the controller 60 determines whether or not the liquid level sensors 240 detect the treatment liquid (S803). In S803, when the middle liquid level sensors 240-2 disposed at the middle position in the front-side liquid pan 224 and the back-side liquid pan 234 detect the treatment liquid (Yes in S803), the process returns to S801.

In S803, when the middle liquid level sensors 240-2 respectively installed in the front-side liquid pan 224 and the back-side liquid pan 234 do not detect the treatment liquid (No in S803), the supply of treatment liquid from the main tank 680 to the sub tank 640 is started (S804). At S804, simultaneously with the driving of the sub pump 660 (the second pump), the main pump 610 is also operated to supply the treatment liquid from the sub tank 640 to the front-side liquid pan 224 and the back-side liquid pan 234. In addition, at S804, simultaneously with the operation of the sub pump 660 and the sub pump 660, the controller 60 causes the air-release solenoid valve 650 to open the airflow path f.

Next, the cumulative operation time of the main pump 610 is reset (S805). In this case, since the main pump 610 and the sub pump 660 are continuously driven, the supply of the treatment liquid from the sub tank 640 to the front-side liquid pan 224 and the back-side liquid pan 234 is continued.

Next, the controller 60 determines whether or not the operation of the image forming apparatus 300 or the like is stopped (S806). In response to a determination that the apparatus is in a stop state (Yes in S806), at S808, the controller 60 stops supply of the treatment liquid (first supply operation) from the sub tank 640 to the front-side liquid pan 224 and the back-side liquid pan 234 in the liquid supply device 600 and ends the process.

In response to a determination that the image forming apparatus 300 or the like is in operation (No in S806), the controller 60 determines whether or not the top liquid level sensor 641 installed at the top level of the sub tank 640 detects the treatment liquid (S807). In S807, when the top liquid level sensor 641 does not detect the treatment liquid (No in S807), the process is returned to S806.

In S807, when the top liquid level sensor 641 detects the treatment liquid (Yes in S807), the operation of the sub pump 660 is stopped (S809), and the process returns to S801. At this time, when the supply of the treatment liquid to the front-side liquid pan 224 and the back-side liquid pan 234 has been completed, the air-release solenoid valve 650 is closed to close the airflow path f.

As described above, in the liquid supply device 600 according to the present embodiment, when the main pump 610 is restarted after the accumulated time of the main pump 610 has passed the predetermined time T1, the sub pump 660 is operated simultaneously with the operation start of the sub pump 660. Such control can shorten the time during which the treatment liquid held in the sub tank 640 contacts the air, and the treatment liquid can be inhibited from being deteriorated.

Figure 9:
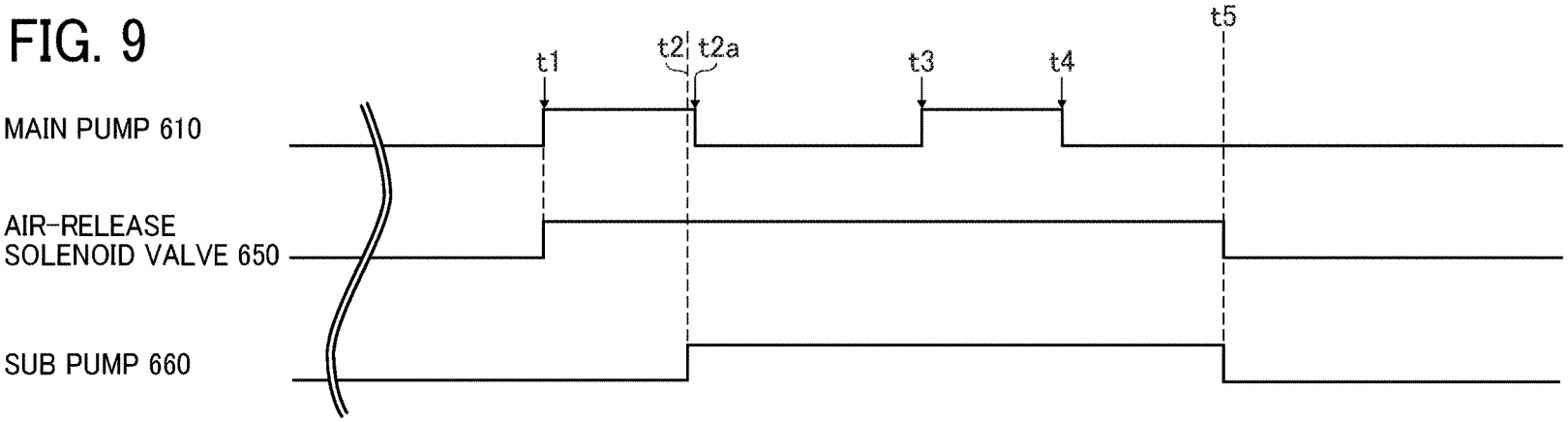
FIG. 9 is a timing chart illustrating operation timing of the comparative liquid supply device.
Figure 10:
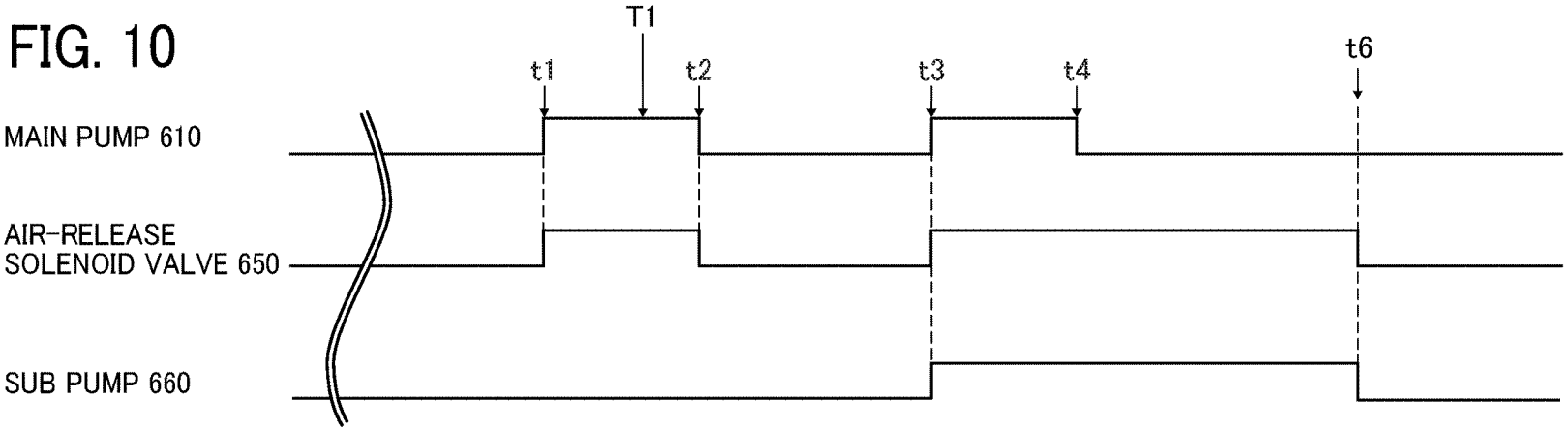
FIG. 10 is a timing chart illustrating an example operation timing of the liquid supply device illustrated in FIG. 5.

Next, differences between the above-described liquid supply method according to the present embodiment and the comparative liquid supply method will be described. FIG. 9 is a timing chart illustrating the operation timing when the main pump 610 and the sub pump 660 independently operate in the case where the sub tank 640 further includes the sensor to detect the liquid level at the middle level like the comparative liquid supply method. FIG. 10 is a timing chart illustrating operation timings of the main pump 610 and the sub pump 660 in the liquid supply method according to the present embodiment.

First, a description is given with reference to FIG. 9. The main pump 610 starts operating at a time t1, at which the middle liquid level sensor 240-2 of the front-side liquid pan 224 or the back-side liquid pan 234 stops detecting the treatment liquid. At the time t1, the air-release solenoid valve 650 opens the airflow path f, and the main pump 610 starts conveying the treatment liquid from the sub tank 640.

When the main pump 610 operates, the treatment liquid in the sub tank 640 decreases. At a time t2, the sensor installed at the middle position of the sub tank 640 stops detecting the treatment liquid, and the operation of the sub pump 660 is started. At this time, when the top liquid level sensors 240-1 of the front-side liquid pan 224 and the back-side liquid pan 234 detect the treatment liquid, the operation of the main pump 610 is stopped at a time t2*a*. However, since the sub pump 660 is in operation, the air-release solenoid valve 650 is kept open.

As the treatment liquid in the front-side liquid pan 224 and the back-side liquid pan 234 continue to be consumed, the middle liquid level sensor 240-2 of the front-side liquid pan 224 or the back-side liquid pan 234 again stops detecting the treatment liquid at a time t3. At this time, the air-release solenoid valve 650 remains open, and the main pump 610 starts operating. Thereafter, when the top liquid level sensors 240-1 of the front-side liquid pan 224 and the back-side liquid pan 234 detect the treatment liquid, the operation of the main pump 610 is stopped. However, the sub pump 660 is in operation, and the air-release solenoid valve 650 is kept in open state (time t4).

When the top liquid level sensor 641 of the sub tank 640 detects the treatment liquid, the operation of the sub pump 660 is stopped and the air-release solenoid valve 650 is closed (time t5). That is, the airflow path f of the sub tank 640 is kept open from when the treatment liquid at the middle position of the sub tank 640 is no longer detected until when the replenishment of the sub tank 640 with the treatment liquid is completed (time t2 to time t5).

As described above, in the comparative liquid supply method, since the main pump 610 and the sub pump 660 are driven asynchronously, when either the main pump 610 or the sub pump 660 is operating, the air-release solenoid valve 650 is kept open. As a result, the air-release solenoid valve 650 is opened for a longer time, exposing the treatment liquid to the atmosphere for a long time via the airflow path f. Accordingly, the treatment liquid easily deteriorates.

On the other hand, in the liquid supply method according to the present embodiment, as illustrated in FIG. 10, the operation start of the main pump 610 is triggered by the stop of detecting of treatment liquid by the middle liquid level sensor 240-2 of either the front-side liquid pan 224 or the back-side liquid pan 234 (time t1). At the time t1, the air-release solenoid valve 650 opens the airflow path f so that the treatment liquid can be sent from the sub tank 640.

Thereafter, when the top liquid level sensor 240-1 of each of the front-side liquid pan 224 and the back-side liquid pan 234 detects the treatment liquid at the time t2, the operation of the main pump 610 is stopped and the air-release solenoid valve 650 is closed. In this case, it is assumed that the cumulative operation time of the main pump 610 has exceeded the predetermined time T1 at a time point between the times t1 and t2.

Next, as long as the operation to consume the treatment liquid of the front-side liquid pan 224 and the back-side liquid pan 234 continues, at the time t3, the middle liquid level sensor 240-2 of either the front-side liquid pan 224 or the back-side liquid pan 234 stops detecting the treatment liquid. Therefore, since the operation of the main pump 610 is started again, the air-release solenoid valve 650 is opened to open the airflow path f, and the treatment liquid can be sent from the sub tank 640 (t3). At the same time, the operation of the sub pump 660 is started. Thus, the liquid supply from the main tank 680 to the sub tank 640 is started.

Thereafter, when the top liquid level sensors 240-1 of the front-side liquid pan 224 and the back-side liquid pan 234 detect the treatment liquid, the operation of the main pump 610 is stopped. However, the air-release solenoid valve 650 is kept open when the sub pump 660 is in operation (t4).

When the top liquid level sensor 641 of the sub tank 640 detects the treatment liquid, the operation of the sub pump 660 is stopped and the air-release solenoid valve 650 is closed (time t6).

That is, when the cumulative operation time of the main pump 610 exceeds the predetermined time T1, the airflow path f of the sub tank 640 is opened again when the operation of the main pump 610 is started. Then, the airflow path f is closed when replenishment of the sub tank 640 with the treatment liquid is completed (t6). As described above, according to the liquid supply method of the present embodiment, the operation start timings of the main pump 610 and the sub pump 660 are synchronized. As a result, the opening time of the air-release solenoid valve 650 can be shortened.

That is, according to the liquid supply method of the present embodiment, the opening time of the air-release solenoid valve 650 can be shortened, and the time during which the treatment liquid contacts the air via the airflow path f can be shortened. As a result, deterioration of the treatment liquid can be inhibited.

Next, effects of the present embodiment are described below. The following description is on the assumption that the flow rate of the main pump 610 is 250 ml/min and the flow rate of the sub pump 660 is 500 ml/min. That is, the maximum supply amount that can be supplied to the front-side liquid pan 224 and the back-side liquid pan 234 by the first supply section is smaller than the maximum of the amount of treatment liquid that can be supplied from the main tank 680 to the sub tank 640 by the second supply section. The term "maximum supply amount" is defined as an amount of the treatment liquid supplied by the pump operating at a maximum power. That is, the main pump 610 is smaller in liquid supply amount per unit time than the sub pump 660.

The predetermined time T1, which is the threshold of the cumulative operation time of the sub pump 660, is set to two minutes. A description is given below of a case where a unit time X is set as illustrated in FIGS. 11 and 12.

Figure 11:
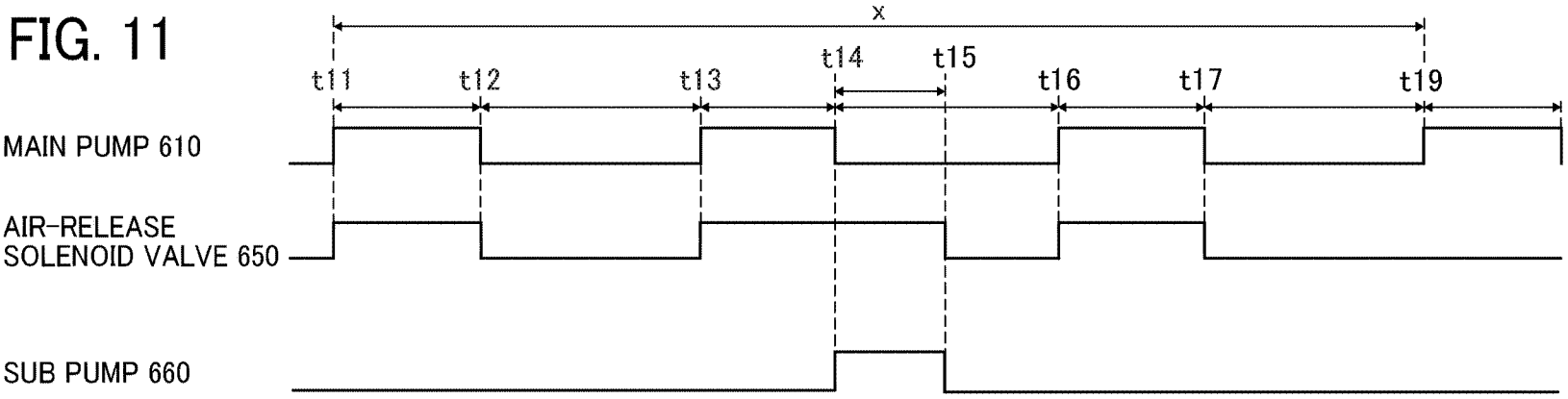
FIG. 11 is a timing chart in a comparative liquid supply method by the comparative liquid supply device.
Figure 12:
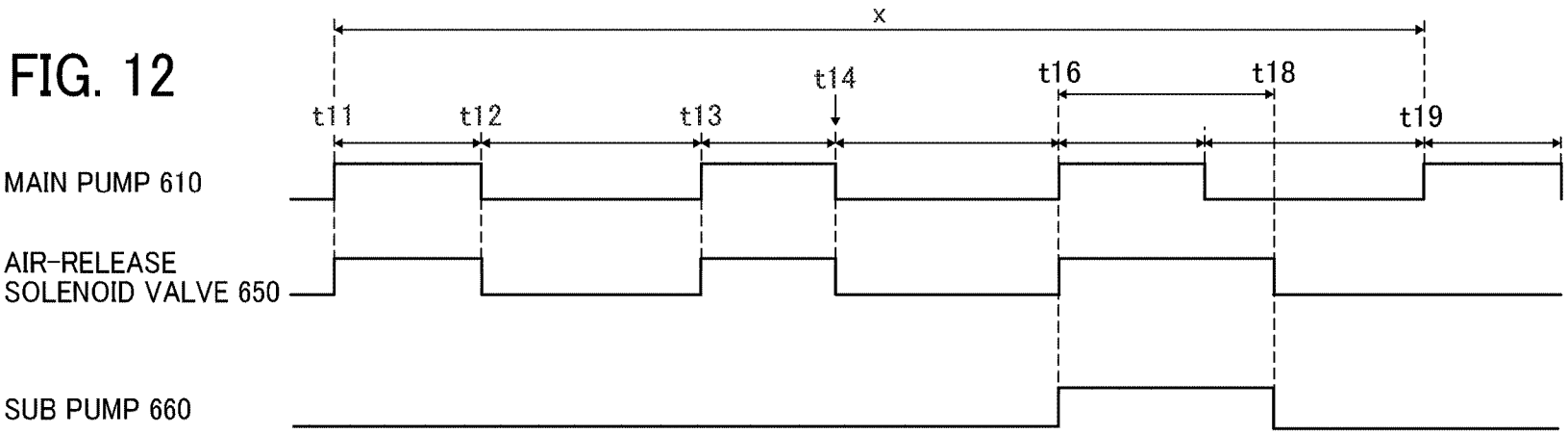
FIG. 12 is a timing chart of the liquid supply device illustrated in FIG. 5 operating according to the liquid supply method illustrated in FIG. 8.

According to the comparative liquid processing method illustrated in FIG. 11, at a time t11 at which the middle liquid level sensor 240-2 of the front-side liquid pan 224 or the back-side liquid pan 234 stops detecting the treatment liquid, the main pump 610 starts operation. At this timing, the air-release solenoid valve 650 is opened to open the airflow path f. Accordingly, the treatment liquid can be sent from the sub tank 640. At a time t12, which is 1 minute from the opening of the air-release solenoid valve 650, the top liquid level sensors 240-1 of the front-side liquid pan 224 and the back-side liquid pan 234 detect the treatment liquid, the main pump 610 stops operating, and the air-release solenoid valve 650 closes the airflow path f.

As 2 minutes have elapsed from the time t12, the middle liquid level sensor 240-2 of the front-side liquid pan 224 or the back-side liquid pan 234 stops detecting the treatment liquid, at a time t13, the main pump 610 starts operating, the air-release solenoid valve 650 opens the airflow path f, and the treatment liquid is sent from the sub tank 640. As 1 minute elapses from the time t13, at a time t14, the top liquid level sensors 240-1 of the front-side liquid pan 224 and the back-side liquid pan 234 detect the treatment liquid, and the main pump 610 stops the operation. However, timing to supply the treatment liquid to the sub tank 640 comes, and the air-release solenoid valve 650 is not closed and the airflow path f is kept open at the time t14.

Since the sub tank 640 is replenished to the top level in one minute, at a time t15, the operation of the sub pump 660 is stopped and the air-release solenoid valve 650 is closed to close the airflow path f. After 1 minute from the time t15 (2 minutes after the time t14 at which the main pump 610 stops operating), the middle liquid level sensor 240-2 of the front-side liquid pan 224 or the back-side liquid pan 234 does not detect the treatment liquid again, and, at a time t16, the main pump 610 starts operating and the air-release solenoid valve 650 opens the airflow path f. Thus, liquid supply from the sub tank 640 is started. Thereafter, the top liquid level sensor 240-1 of the front-side liquid pan 224 and the back-side liquid pan 234 detects the treatment liquid in 1 minute, the main pump 610 stops operating, and the air-release solenoid valve 650 closes the airflow path f (t17).

In the comparative example based on the above-described conditions, the opening time of the air-release solenoid valve 650 per unit time X is four minutes.

On the contrary, as illustrated in FIG. 12, in the liquid supply method according to the present embodiment, the main pump 610 starts operating at the time t11, at which the middle liquid level sensor 240-2 of the front-side liquid pan 224 or the back-side liquid pan 234 stops detecting the treatment liquid. At this timing, the air-release solenoid valve 650 opens and the airflow path f is opened. At a time t12, which is 1 minute from the opening of the air-release solenoid valve 650, the top liquid level sensors 240-1 of the front-side liquid pan 224 and the back-side liquid pan 234 detect the treatment liquid, the main pump 610 stops operating, and the air-release solenoid valve 650 closes the airflow path f.

After 2 minutes from the time t12, the middle liquid level sensor 240-2 of either the front-side liquid pan 224 or the back-side liquid pan 234 stops detecting the treatment liquid at the time t13. At the time t13, the main pump 610 starts operation, and the air-release solenoid valve 650 opens the airflow path f. Thus, liquid supply from the sub tank 640 is started. Thereafter, the top liquid level sensors 240-1 of the front-side liquid pan 224 and the back-side liquid pan 234 detect the treatment liquid in 1 minute, and the operation of the main pump 610 is stopped. At this point, sub pump 660 does not start operation. Further, the cumulative operation time of the main pump 610 is "two minutes", which is equal to or longer than the predetermined time T1.

After 2 minutes from the time t14, at which the main pump 610 stops operating, the middle liquid level sensor 240-2 of the front-side liquid pan 224 or the back-side liquid pan 234 stops detecting the treatment liquid again (t16). Accordingly, the main pump 610 starts operating, the air-release solenoid valve 650 opens the airflow path f, and liquid supply from the sub tank 640 is started (t16). At this time, the operation of the sub pump 660 is also started. Since the air-release solenoid valve 650 has already been opened, opening the airflow path f again is not required.

In 1 minute after the time t16, the top liquid level sensors 240-1 of the front-side liquid pan 224 and the back-side liquid pan 234 detect the treatment liquid. Accordingly, the main pump 610 stops operation. However, the sub pump 660 continues the operation since the top liquid level sensor 641 of the sub tank 640 has not yet detected the treatment liquid. Therefore, the air-release solenoid valve 650 is kept open.

Since the top liquid level sensor 641 detects the treatment liquid one and a half minutes after the operation start of the sub pump 660 (t16), the operation of the sub pump 660 is stopped and the air-release solenoid valve 650 closes the airflow path f (t18).

According to the present embodiment based on the above-described conditions, the opening time of the air-release solenoid valve 650 per unit time X is 3 minutes and 30 seconds. Therefore, the opening time of the air-release solenoid valve 650 can be shortened by 30 seconds as compared with the comparative example.

Aspects of this disclosure mainly relates to the liquid supply device and the liquid supply method. According to an aspect of the present disclosure, treatment liquid, which includes a treatment agent, is supplied from a tank to a liquid reservoir to store the treatment liquid so that the treatment liquid is ready to be used in predetermined treatment, and timing of supply of the treatment liquid to the liquid reservoir is synchronized with timing of replenishment of the tank with the treatment liquid. Synchronizing the timing of supply of the treatment liquid to the liquid reservoir with timing of replenishment of the tank is advantageous in shortening the time during which the treatment liquid contacts air, thereby suppressing degradation of the treatment liquid. Thus, the degradation of the liquid due to air contact can be suppressed while reducing the number of sensors used to detect the liquid level.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

At least a portion of the above-described methods according to embodiments can be implemented by a program stored in non-transitory storage media. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid supply device comprising:

a first tank configured to store a liquid;

a first pump configured to supply the liquid from the first tank to a liquid pan, as a first supply operation;

a second tank coupled to the first tank;

a second pump configured to supply the liquid from the second tank to the first tank, as a second supply operation; and a circuitry configured to:

control the first supply operation and the second supply operation, accumulate an operation time of the first supply operation; and start the second supply operation at a start of the first supply operation under a condition where a cumulative operation time of the first supply operation is equal to or longer than a threshold.

2. The liquid supply device according to claim 1, wherein an amount of the liquid supplied to the liquid pan in the first supply operation is referred to as a supply amount in the first supply operation, and wherein the threshold is longer than a first time for the first pump to supply, to the liquid pan, 20% of the supply amount in the first supply operation and shorter than a second time for the first pump to supply 40% of the supply amount in the first supply operation.

3. The liquid supply device according to claim 1, wherein an amount of the liquid supplied to the liquid pan in the first supply operation is referred to as a supply amount in the first supply operation, and wherein the circuitry is configured to set the supply amount in the first supply operation smaller than an amount of the liquid supplied to the first tank in the second supply operation.

4. The liquid supply device according to claim 1, wherein the first tank includes:

an airflow path configured to communicate an interior of the first tank with outside of the first tank; and a valve configured to open and close the airflow path, wherein the circuitry is configured to cause the valve to open the airflow path at a start of operation of the first pump and a start of operation of the second pump.

5. The liquid supply device according to claim 1, wherein the circuitry is configured to set an amount per unit time of the liquid supplied to the liquid pan in the first supply operation smaller than an amount per unit time of the liquid supplied to the first tank in the second supply operation.

6. A liquid application apparatus comprising:

the liquid pan; and the liquid supply device according to claim 1, to supply the liquid to the liquid pan.

7. An image forming system comprising:

the liquid application apparatus according to claim 6, to apply the liquid to a recording medium; and an image forming apparatus to form an image on the recording medium applied with the liquid by the liquid application apparatus.

8. A liquid supply method comprising:

supplying a liquid from a first tank to a liquid pan, as a first supply operation;

supplying the liquid from a second tank to the first tank, as a second supply operation;

accumulating an operation time of the first supply operation;

determining whether a cumulative operation time of the first supply operation is equal to or greater than a threshold;

determining a start of the first supply operation after a determination that the cumulative operation time of the first supply operation is equal to or greater than the threshold; and starting the second supply operation at the start of the first supply operation.

9. A non-transitory recording medium storing computer-readable codes for causing a computer to carry out a liquid supply method, the method comprising:

supplying a liquid from a first tank to a liquid pan, as a first supply operation;

supplying the liquid from a second tank to the first tank, as a second supply operation;

accumulating an operation time of the first supply operation;

determining whether a cumulative operation time of the first supply operation is equal to or greater than a threshold;

determining a start of the first supply operation after a determination that the cumulative operation time of the first supply operation is equal to or greater than the threshold; and starting the second supply operation at the start of the first supply operation.

* * * * *